US010504647B2

(12) United States Patent
Renteria et al.

(10) Patent No.: US 10,504,647 B2
(45) Date of Patent: Dec. 10, 2019

(54) MAGNETIC TRANSFORMER HAVING INCREASED BANDWIDTH FOR HIGH SPEED DATA COMMUNICATIONS

(71) Applicant: Bel Fuse (Macao Commercial Offshore) Limited, Andar H-J (MO)

(72) Inventors: Victor H. Renteria, Poway, CA (US); Chun Wing (Alan) Ng, Tuen Mun (HK); Wai Shun Leung, Tseung Kwan O New Town (HK)

(73) Assignee: Bel Fuse (Macao Commercial Off, Macau ( * ) Notice: Subject to any disclaimer, the term of this patent is extended or adjusted under 35 U.S.C. 154(b) by 49 days.

(21) Appl. No.: 15/725,047

(22) Filed: Oct. 4, 2017

(65) Prior Publication Data

US 2018/0286577 A1 Oct. 4, 2018

Related U.S. Application Data

(60) Provisional application No. 62/480,757, filed on Apr. 3, 2017.

(51) Int. Cl.
*H01F 27/24* (2006.01)
*H01F 38/14* (2006.01)
(Continued)

(52) U.S. Cl.
CPC ..... *H01F 38/14* (2013.01); *H01F 27/24* (2013.01); *H01F 27/2823* (2013.01); *H01F 27/29* (2013.01)

(58) Field of Classification Search
CPC ..... H01F 38/14; H01F 27/29; H01F 27/24; H01F 27/2823; H01F 41/07; H01F 41/08; H01F 2017/067; H01F 2019/085
(Continued)

(56) References Cited

U.S. PATENT DOCUMENTS 3,783,415 A * 1/1974 Koskinen ..... H03H 7/38 333/25
4,173,742 A * 11/1979 Lehmann ..... H01F 19/04 333/100
(Continued)

OTHER PUBLICATIONS

International Search Report and Written Opinion for International Application PCT/US2018/025858, dated Jun. 22, 2018, 13 pages.

*Primary Examiner* — Mang Tin Bik Lian
(74) *Attorney, Agent, or Firm* — Patterson Intellectual Property Law, P.C.; Gary L. Montle; Jerry Turner Sewell

(57) ABSTRACT

An isolation transformer includes a transformer core. First and second through-bores extend through the transformer core from a first surface to a second surface. Each through-bore has an elongated profile with at least a portion of the elongated profile providing a respective flat winding surface. The flat winding surfaces are spaced apart by a central portion of the transformer core. The transformer is wound with a six-wire cable having a central non-conductive core. First, second, third, fourth, fifth and sixth conductive wires are positioned around and adjacent to the central non-conductive core in a substantially equally spaced angular relationship. The second conductive wire is positioned between the first conductive wire and the third conductive wire; and the fifth conductive wire is positioned between the fourth conductive wire and the sixth conductive wire. The conductive wires are twisted about the central non-conductive core at a selected twist density.

2 Claims, 11 Drawing Sheets

(51) Int. Cl.
*H01F 27/29* (2006.01)
*H01F 27/28* (2006.01)

(58) Field of Classification Search
USPC ..... 336/220–222, 170, 192, 136, 150, 147
See application file for complete search history.

(56) References Cited

U.S. PATENT DOCUMENTS

| | | | | |
|---|---|---|---|---|
| 5,220,297 | A * | 6/1993 | Crowhurst | H01F 19/04 29/602.1 |
| 6,087,916 | A * | 7/2000 | Kutkut | H01F 27/22 336/195 |
| 6,806,790 | B2 * | 10/2004 | Ji | H03H 3/00 333/118 |
| 6,963,255 | B2 * | 11/2005 | Zheng | H03H 7/48 333/109 |
| 7,429,195 | B2 | 9/2008 | Buckmeier et al. | |
| 7,924,130 | B2 | 4/2011 | Buckmeier et al. | |
| 8,077,004 | B2 | 12/2011 | Buckmeier et al. | |
| 8,269,592 | B1 * | 9/2012 | McCauley, IV | H01F 27/28 336/175 |
| 8,405,481 | B2 | 3/2013 | Renteria | |
| 8,576,037 | B1 * | 11/2013 | Ji | H01F 30/04 336/148 |
| 8,869,383 | B2 * | 10/2014 | Xu | H01F 17/062 29/602.1 |
| 9,071,229 | B1 * | 6/2015 | Ji | H03H 7/42 |
| 2001/0000590 | A1 | 5/2001 | Valadez et al. | |
| 2007/0040645 | A1 | 2/2007 | Sedio et al. | |
| 2009/0265918 | A1 | 10/2009 | Dounaevsky | |
| 2016/0093431 | A1 | 3/2016 | Quilici | |
| 2016/0172079 | A1 | 6/2016 | Rohrer | |

* cited by examiner

MAGNETIC TRANSFORMER HAVING INCREASED BANDWIDTH FOR HIGH SPEED DATA COMMUNICATIONS

RELATED APPLICATION

The present application claims the benefit of priority under 35 USC § 119(e) to U.S. Provisional Application No. 62/480,757, filed on Apr. 3, 2017, which is incorporated by reference herein in its entirety.

BACKGROUND OF THE INVENTION

Field of the Invention

This application is directed to conductors and circuit elements for use in high speed data communications, and, more particularly, to improvements in baluns and twisted wire cables.

Description of the Related Art

Transformers are devices that transfer electrical energy from one electrical circuit to another electrical circuit through the use of inductively coupled conductors. As is well understood, a varying current in a primary winding creates a varying magnetic flux and thus a varying magnetic field through a secondary winding. This varying magnetic field induces a varying electromotive force ("EMF") or voltage in the secondary winding. An ideal transformer assumes that all the magnetic flux generated by the primary winding is coupled to every secondary winding of the transformer. In practice however, some of the magnetic flux generated by the primary winding exists outside the secondary windings, thereby giving the appearance that the transformer has an inductance in series with the transformer windings. This non-ideal operating characteristic is known as leakage inductance.

Leakage inductance is caused by an imperfect coupling of the windings, which creates a leakage flux that does not link with all the turns of the secondary transformer windings. As a result, the voltage drops across the leakage reactance of the circuit resulting in a less than ideal voltage regulation, especially when the transformer is placed under load. This is particularly problematic in high frequency applications where the high frequency of the electrical current exacerbates the non-ideal parasitic effects seen in the transformer.

For years, engineers have recognized that reducing the amount of leakage inductance seen on a transformer increases the high frequency performance of the transformer. Heretofore, the most commonly used methods to reduce the amount of leakage inductance seen in a transformer has traditionally been by twisting the primary and secondary wires together, interleaving the windings (e.g., interspersing individual or layers of primary windings with secondary windings), or alternatively implementing a combination of both twisting and interleaving of the windings in order to increase the coupling between windings. The purpose of both twisting and interleaving techniques is to attempt to distribute electromagnetic energy (both internal energy and externally generated energy) to each of the primary and secondary windings as equally and as completely as possible. However, while it is possible to implement a combination of twisting and interleaving, twisting is often extremely difficult to accomplish when interleaving more than one set of windings. This is primarily a result of the fact that once you have more than one interleaved winding, the order of the wires in the bundle needs to be carefully controlled in order to obtain the best coupling. This is often difficult to achieve when using both interleaving in combination with wire twisting.

For high frequency communications, small transformers with relatively few windings are used to electrically isolate network data lines from local circuitry so that any potential differences to ground between the network data lines and the local circuitry do not result in current flow between the data lines and the local circuitry. For example, FIG. 1 illustrates a known transformer 100 that may be used for isolation. Such an isolation transformer is often referred to as a "balun." As illustrated, the transformer includes a core 102 that comprises a magnetically permeable material having a relative magnetic permeability ($\mu/\mu_0$) of, for example, 1,500 to 5,000. A plurality of wires 104 are wound onto the core to form the windings of the transformer. In the illustrated embodiment, the wires are grouped in multi-wire (e.g., three-wire) cables. For example, a first three-wire cable 106 may include two primary wires and one secondary wire and a second three-wire cable 108 may include two additional primary wires another secondary wire. The three wires in each cable are twisted together to cause the three wires in each cable to encounter similar perturbations causes by electromagnetic noise.

The transformer core 102 is formed as an oval-shaped (e.g., racetrack-shaped) body 110 with a first cylindrical through-bore 112 spaced apart from a second cylindrical through-bore 114. An example of such a transformer is described in detail in U.S. Pat. No. 7,924,130 for "Isolation Magnetic Devices Capable of Handling High-Speed Communications," which is incorporated by reference herein in its entirety. As described in U.S. Pat. No. 7,924,130, the completed transformer is formed by threading the wires (cables) 104 through the first through-bore and through the second through-bore to form the windings of the transformer. The ends of wires are selectively interconnected to define the primary and secondary windings of the transformer. One skilled in the art will appreciate that the circular through-bores that receive the wires cause the wires threaded through the through-bores to be spaced apart differently along the circumferences of the through-bores. For example, the turns of the wires positioned near the center of the core are closer together across the thickness of the core between the through-bores than the turns of the wires that are farther from the center of the core. As further shown in the cross-sectional view of FIG. 2, the wires (cables) tend to bunch up within the through-bores rather than being evenly distributed within the through-bores. In some configurations, the bunching of the wires may cause the start of a particular winding to be positioned near the finish of the particular winding, which may increase the parasitic capacitance between the start and the finish of the winding.

SUMMARY OF THE INVENTION

Although the previously described cable and transformers are adequate for high-speed data communications up to certain data transmission rates (e.g., up to 400 MHz frequency range), the need for higher data transmission rates has resulted in a need for improvements in the coupling between the primary and secondary windings of the transformer.

In view of the foregoing, a need exists for a system and method that provides enhanced coupling between the windings of an isolation transformer in a high speed data communications coupler system.

One aspect of the embodiments disclosed herein is an isolation transformer that includes a transformer core. First and second through-bores extend through the transformer core from a first surface to a second surface. Each through-bore has an elongated profile with at least a portion of the elongated profile providing a respective flat winding surface. The flat winding surfaces are spaced apart by a central portion of the transformer core. The transformer is wound with a six-wire cable having a central non-conductive core. First, second, third, fourth, fifth and sixth conductive wires are positioned around and adjacent to the central non-conductive core in a substantially equally spaced angular relationship. The second conductive wire is positioned between the first conductive wire and the third conductive wire; and the fifth conductive wire is positioned between the fourth conductive wire and the sixth conductive wire. The conductive wires are twisted about the central non-conductive core at a selected twist density.

Another aspect of the embodiments disclosed herein is an isolation transformer comprising a transformer core having a first surface and a second surface. A first through-bore extends through the transformer core from the first surface to the second surface. The first through-bore has an elongated profile with at least a portion of the elongated profile providing a first flat winding surface. A second through-bore extends through the transformer core from the first surface to the second surface. The second through-bore has an elongated profile with at least a portion of the elongated profile providing a second flat winding surface. The second flat winding surface is spaced apart from the first flat winding surface by a central portion of the transformer core. The transformer further includes at least one multi-wire cable comprising a first conductive wire, a second conductive wire, a third conductive wire, a fourth conductive wire, a fifth conductive wire, and a sixth conductive wire. The second conductive wire is positioned between the first conductive wire and the third conductive wire. The fifth conductive wire is positioned between the fourth conductive wire and the sixth conductive wire. In certain embodiments, each of the first and second through-bores has an oval-shaped profile having a central rectangular portion, a first semicircular end portion and a second semicircular end portion. Each of the first and second flat winding portions is defined by a respective side of the central rectangular portion of the respective through-bore. In certain embodiments, the at least one multi-wire cable includes a first three-wire cable that includes the first conductive wire, the second conductive wire and the third conductive wire, wherein the first, second and third conductive wires twisted together; and further includes a second three-wire cable that includes the fourth conductive wire, the fifth conductive wire and the sixth conductive wire, wherein the fourth, fifth and sixth conductive wires twisted together. In certain embodiments, the first three-wire cable and the second three-wire cable are wound onto the transformer core with one turn of the first three-wire cable positioned between adjacent turns of the second three-wire core. In other certain embodiments, the at least one multi-wire cable comprises a six-wire cable that includes the first conductive wire, the second conductive wire, the third conductive wire, the fourth conductive wire, the fifth conductive wire and the sixth conductive wire, wherein the first, second, third, fourth, fifth and sixth conductive wires are helically wound about a central non-conductive core.

Another aspect of the embodiments disclosed herein is a transformer core comprising a magnetic material formed into a solid having at least a first surface and a second surface. A first through-bore extends through the magnetic material from the first surface to the second surface. The first through-bore has an elongated profile with at least a portion of the elongated profile providing a first flat winding surface. A second through-bore extends through the magnetic material from the first surface to the second surface. The second through-bore has an elongated profile with at least a portion of the elongated profile providing a second flat winding surface. The second flat winding surface is spaced apart from the first flat winding surface by a central portion of the magnetic material. In certain embodiments in accordance with this aspect, each of the first and second through-bores has an oval-shaped profile having a central rectangular portion, a first semicircular end portion and a second semicircular end portion. Each of the first and second flat winding portions is defined by a respective side of the central rectangular portion of the respective through-bore.

Another aspect of the embodiments disclosed herein is a multi-wire cable for a transformer winding. The cable comprises a central non-conductive core. At least a first conductive wire, a second conductive wire, a third conductive wire, a fourth conductive wire, a fifth conductive wire, and a sixth conductive wire are positioned around and adjacent to the central non-conductive core in a substantially equally spaced angular relationship. The second conductive wire is positioned between the first conductive wire and the third conductive wire. The fifth conductive wire is positioned between the fourth conductive wire and the sixth conductive wire. The conductive wires are twisted about the central non-conductive core at a selected twist density. In certain embodiments in accordance with this aspect, each conductive wire has a common diameter corresponding to a selected wire gauge. The central non-conductive core has a diameter at least as great as the common diameter of the conducive wires. In certain embodiments in accordance with this aspect, the central non-conductive core comprises a monofilament material. In certain embodiments in accordance with this aspect, the multi-wire cable comprises only six conductive wires and the central non-conductive wire. In certain embodiments in accordance with this aspect, the multi-wire cable comprises eight conductive wires and the central non-conductive wire. In certain embodiments in accordance with this aspect, the multi-wire cable comprises nine conductive wires and the central non-conductive wire.

Another aspect of the embodiments disclosed herein is high data rate coupler system comprising an isolation transformer and a choke. The isolation transformer includes a core having a first surface and a second surface. A first through-bore extends through the transformer core from the first surface to the second surface. The first through-bore has an elongated profile with at least a portion of the elongated profile providing a first flat winding surface. A second through-bore extends through the transformer core from the first surface to the second surface. The second through-bore has an elongated profile with at least a portion of the elongated profile providing a second flat winding surface. The second flat winding surface is spaced apart from the first flat winding surface by a central portion of the transformer core. The transformer further includes at least one multi-wire cable comprising a central non-conductive core, a first conductive wire, a second conductive wire, a third conductive wire, a fourth conductive wire, a fifth conductive wire, and a sixth conductive wire. The second conductive wire is positioned between the first conductive wire and the third conductive wire. The fifth conductive wire is positioned between the fourth conductive wire and the sixth conductive wire. The first and third conductive wires form a first primary winding of the isolation transformer; and the fourth and sixth conductive wires form a second primary winding of the isolation transformer. The first and second primary windings are connected in series to form a center-tapped primary winding. The second wire forms a first secondary winding of the isolation transformer, and the fifth wire forms a second secondary winding of the isolation transformer. The first and second secondary windings are connected in series to form a center-tapped secondary winding. The choke is wound with respective end segments of the second conductive wire and the fifth conductive wire. In certain embodiments in accordance with this aspect, the at least one multi-wire cable comprises six conductive wires and a central non-conductive wire. In other embodiments in accordance with this aspect, the at least one multi-wire cable comprises a first three-wire cable and a second three-wire cable. In certain embodiments having the first three-wire cable and the second three-wire cable, the first, second and third conductive wires are in the first three-wire cable, and wherein the fourth, fifth and sixth conductive wires are in the second three-wire cable.

BRIEF DESCRIPTION OF THE DRAWINGS

The foregoing aspects and other aspects of this disclosure are described in detail below in connection with the accompanying drawing figures in which.

DETAILED DESCRIPTION OF PREFERRED EMBODIMENTS

An improved high data rate isolation transformer is disclosed in the attached drawings and is described below. The embodiment is disclosed for illustration of the transformer and is not limiting except as defined in the appended claims.

Figure 2:
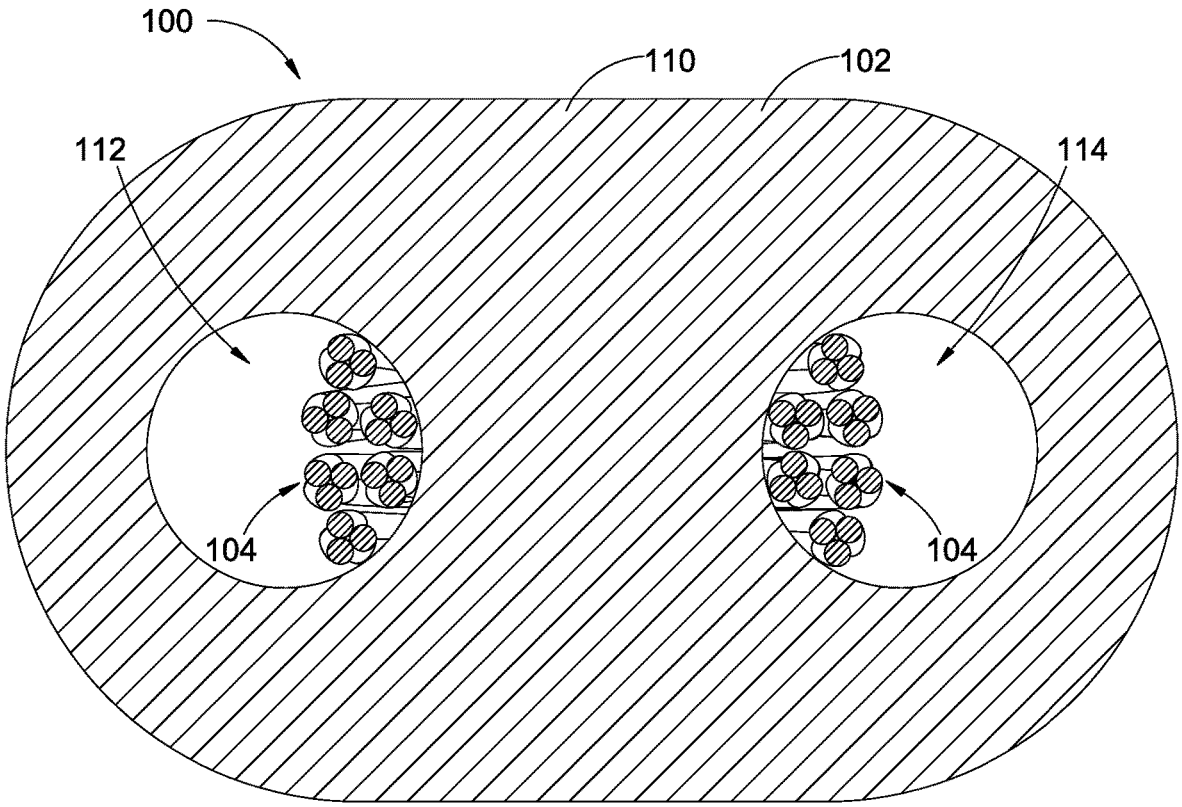
FIG. 2 illustrates a cross-sectional view of the isolation transformer of FIG. 1 taken along the line 2-2 in FIG. 2.
Figure 3:
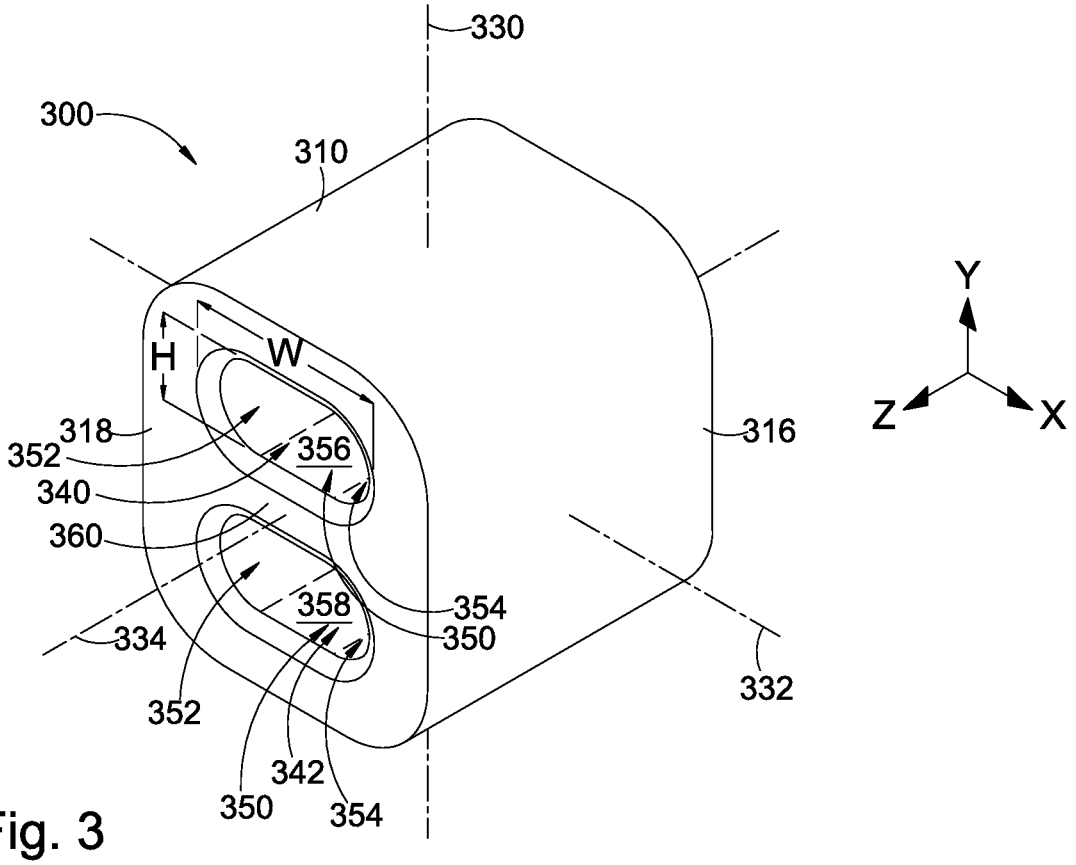
FIG. 3 illustrates a perspective view of a transformer core having elongated through-bores, the view showing the front, top and right sides of the transformer core.
Figure 4:
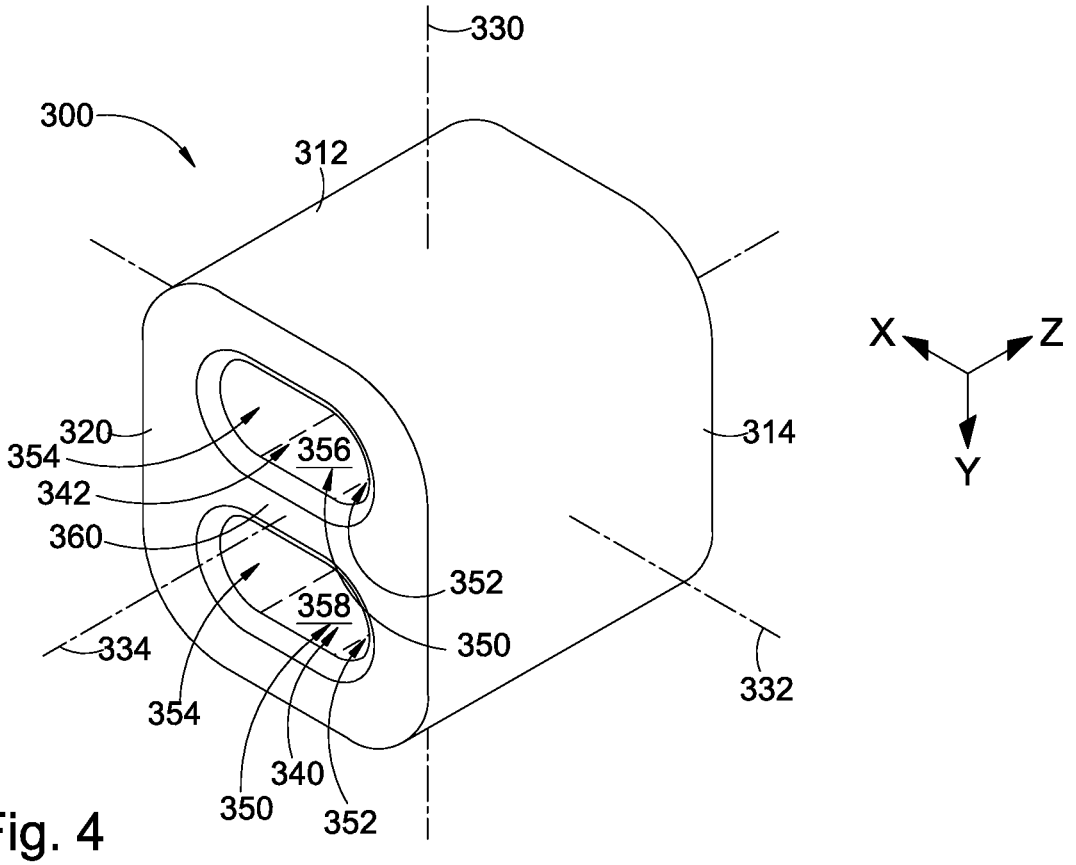
FIG. 4 illustrates a rotated perspective view of the transformer core of FIG. 3, the view showing the rear, bottom and left sides of the transformer core.

FIGS. 3 and 4 illustrate a transformer core 300 in accordance with a disclosed implementation. Unlike the core of the previously described oval-shaped transformer 100 of FIGS. 1 and 2, the transformer core 300 in FIGS. 3 and 4 has an overall box-like (parallelepiped) appearance having six generally rectangular sides. In the illustrated orientation referenced to X, Y and Z coordinates, the core has a top surface 310, a bottom surface 312, a left surface 314, a right surface 316, a front surface 318 and a rear surface 320. A first (top-bottom) central axis 330 passes through the center of the core from the top surface to the bottom surface parallel to the Y axis. A second (left-right) central axis 332 passes through the center of the core from the left surface to the right surface parallel to the X axis. A third (front-rear) central axis 334 passes through the center of the core from the front surface to the rear surface parallel to the Z axis. The three central axes intersect at the center of the core. The references to top, bottom, left, right, front and rear are for convenience in providing the following description. One skilled in the art will appreciate that the transformer core can be oriented in a variety of different orientations during construction and in use.

In the illustrated embodiment, the transformer core 300 has a height along the top-bottom central axis 330 of approximately 0.136 inch, a width along the left-right central axis 332 of approximately 0.120 inch and a thickness (depth) along the front-rear axis 334 of approximately 0.120 inch. The dimensions are for example only and are not intended to be limiting. As further shown in FIG. 3, the edges between the top surface 310 and the bottom surface 312 and the adjacent left surface 314 and right surface 316 may be filleted (e.g., rounded) to remove the sharp edges.

As further illustrated in FIGS. 3 and 4, the transformer core 300 includes a first elongated through-bore 340 and a second elongated through-bore 342. Each elongated through-bore extends through the core from the front surface 318 to the rear surface 320 in parallel with the front-rear central axis 334. In the illustrated embodiment, the two elongated through-bores are spaced substantially equally distant from the front-rear central axis and are also spaced equal distant from the left-right central axis 332 of the core.

Figure 1:
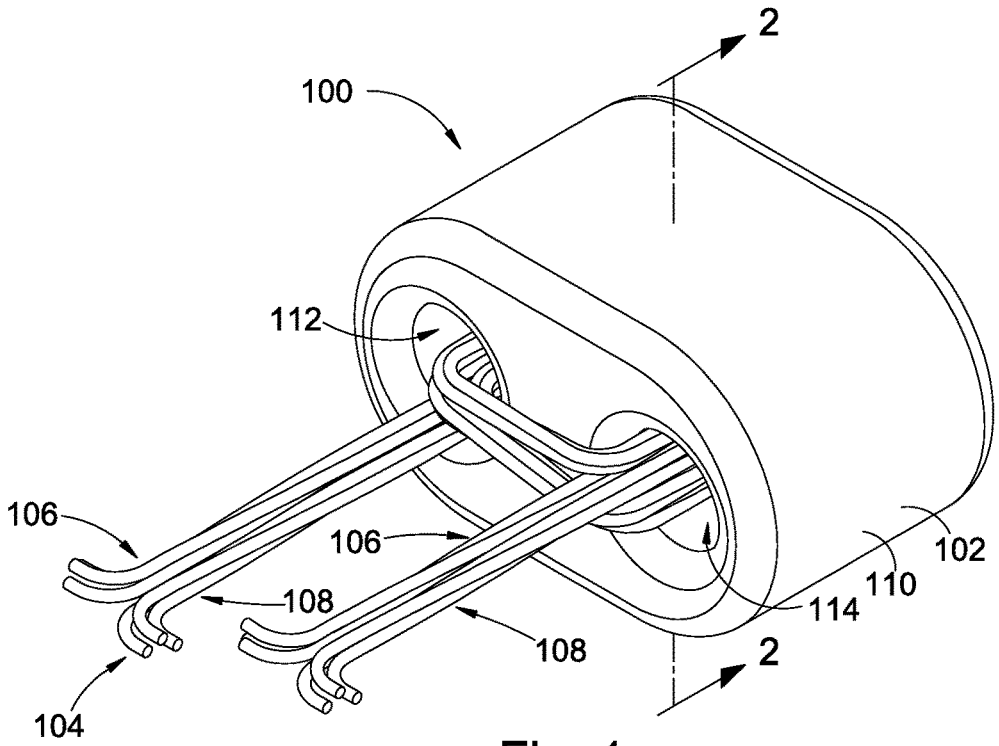
FIG. 1 illustrates a perspective view of a known isolation transformer.

Unlike the previously described circular through-bores 110, 112 of the core 100 of FIG. 1, the elongated through-bores 340, 342 of the transformer core 300 of FIGS. 3 and 4 are generally oval-shaped (e.g., racetrack-shaped). Each through-bore is wider in a left-to-right direction parallel to the left-right central axis 332 and is narrower in a top-to-bottom direction parallel to the top-bottom central axis 330. Each elongated through-bore has a generally rectangular central portion 350. A first semicircular end portion 352 extends from the left end of the rectangular central portion. A second semicircular end portion 354 extends from the right end of the rectangular central portion. Each elongated through-bore has a respective inner flat surface 356 that is nearest to the center of the core and a respective outer flat surface 358 that is farthest from the center of the core. A central portion 360 of the core extends from the front surface 318 to the rear surface 320 of the core between the two through-bores. The central portion of the core has a nominal height between the respective flat surfaces of the two through-bores.

In the illustrated embodiment, each elongated through-bore 340, 342 has an overall width (W) from the outer perimeter of the respective first semicircular end portion 352 to the outer perimeter of the second semicircular portion 354 of approximately 0.065 inch. In the illustrated embodiment, each elongated through-bore has a height (H) from the respective inner flat surface to the respective outer flat surface of approximately 0.034 inch, which corresponds to the diameter of each semicircular end portion. The rectangular central portion 350 of each elongated through-bore has a width of approximately 0.31 inch. The inner flat surfaces of the through-bores are spaced apart from each other by approximately 0.23 inch, which corresponds to the height of the central portion 360 of the core. The foregoing dimensions and the spacing of the elongated through-bores are examples only and are not intended to be limiting.

Figure 5:
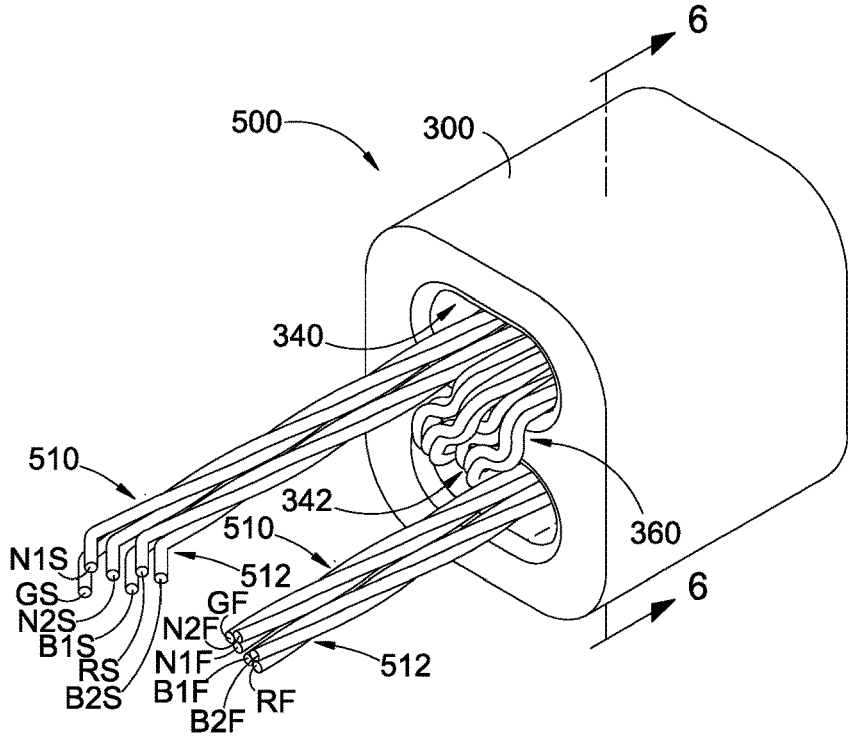
FIG. 5 illustrates a perspective view of a transformer incorporating the core of FIGS. 3 and 4, the transformer including first and second coils comprising three turns each of first and second three-wire cables.
Figure 6:
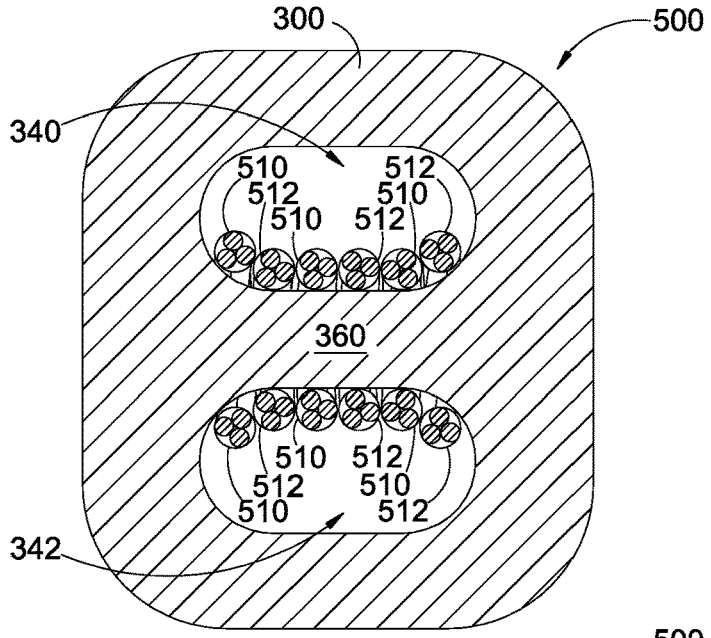
FIG. 6 illustrates a cross-sectional view of the transformer of FIG. 5 taken along the line 6-6 of FIG. 5.
Figure 7:
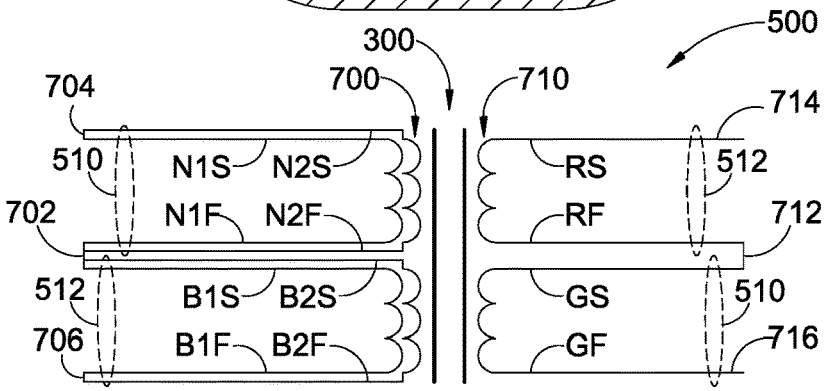
FIG. 7 illustrates a schematic diagram of the transformer of FIGS. 5 and 6.

FIG. 5 illustrates a perspective view of the transformer core 300 of FIGS. 3 and 4 configured as part of a transformer 500 with a plurality of turns of wires wound through the elongated through-bores 340, 342 and around the central portion 360 of the core. FIG. 6 is a cross-sectional view of the transformer of FIG. 5. In the illustrated embodiment, a first three-wire cable 510 and a second three-wire cable 512 are wound around the central portion of the core in an interleaved fashion such that three turns of the first cable are interleaved with three turns of the second cable. The resulting transformer is illustrated schematically in FIG. 7. For convenience in the following description, two of the wires in the first cable are labeled as N1 and N2, and the third wire in the first cable is labeled as G. Two of the wires in the second cable are labeled in FIGS. 5-7 as B1 and B2, and the third wire in the second cable is labeled as R. In FIGS. 5-7, the start of each wire (upper left) in FIG. 6 is further identified with an S suffix, and the finish of each wire is labeled with an F suffix. The start of each wire is threaded first through the second (lower) elongated through-bore and out through the first (upper) through bore. The finish of each wire extends from the second (lower) elongated through-bore. The start and finish identifications can be interchanged.

As illustrated schematically in FIG. 7, in a particular application of the transformer 500 of FIGS. 5 and 6, the starts (N1S and N2S) of the N1 and N2 wires of the first cable 510 are connected together, and the finishes (N1F and N2F) of the N1 and N2 wires are connected together such that the N1 and N2 wires are connected in parallel for winding about the central portion of the core. The starts (B1S and B2S) of the B1 and B2 wires in the second cable 512 are connected together, and the finishes (B1F and B2F) of the B1 and B2 wires are connected together such that the B1 and B2 wires are connected in parallel for winding about the central portion of the core. The interconnected finishes (N1F and N2F) of the N1 and N2 wires of the first cable are further connected to the starts (B1S and B2S) of the B1 and B2 wires of the second cable such that the parallel connected N1 and N2 wires and the parallel connected B1 and B2 wires are connected in series as a continuous six-turn primary winding 700 of the transformer. The interconnected finishes N1F, N2F of the N1 and N2 wires and the starts B1S, B2S of the B1 and B2 wires form a center-tap 702 of the primary winding as shown in the schematic diagram. The interconnected N1S and N2S end segments of the N1 and N2 wires form a first outer lead 704 of the primary winding. The interconnected B1F and B2F end segments of the B1 and B2 wires form a second outer lead 706 of the primary winding.

As further illustrated in FIG. 7, the finish (RF) of the R wire in the second cable 512 is connected to the start (GS) of the G wire in the first cable 510 such that the R wire and the G wire are connected in series as a six-turn secondary winding. The common connection of the finish (RF) of the R wire and the start (GS) of the G wire forms a center-tap 712 of a secondary winding 710 of the transformer 500 as shown in the schematic diagram. The RS end segment of the R wire forms a first outer lead 714 of the secondary winding. The GF end segment of the G wire forms a second outer lead 716 of the secondary winding. In the illustrated embodiment, the secondary windings are interconnected in a cross-coupled configuration as shown to further improve impedance matching in the passband by adding half of the interwinding capacitance and reducing the leakage inductance.

As shown in a cross-sectional view in FIG. 6, the two cables 510, 512 are positioned against the respective inner flat surfaces 356 (see element number 356 in FIGS. 3 and 4) of the elongated through-bores 340, 342 such that each turn of each cable is positioned adjacent the central portion 360 of the transformer core 300. If the sum of the diameters of the adjacent turns of the wire exceed the extent of the flat inner surfaces, the turns of the wires at one or both ends of the flat inner surfaces may extend into the semicircular end portions 352, 354 as shown; however, the small difference in the height of the central portion of the core between the respective end turns relative to the nominal height of the central portion of the core between the flat inner surfaces of the elongated through-holes does not substantially affect the desired uniformity of the coupling between the turns of the wires.

The structure of the transformer 500 of FIGS. 5-7 improves the operation of transformers at higher data communications rates by increasing the coupling between the turns of the wires in the windings and also reducing the parasitic elements in the transformer that are parallel with the winding (e.g., the distributed capacitance between the start of the winding and the finish of the winding, which are at opposite ends of the elongated bores as shown in FIG. 7.

The two interleaved three-wire cables 510, 512 of FIGS. 5-7 of the transformer 500 provide coupling between the primary winding and the secondary winding for data communications at wide bandwidths up to approximately 1,800 MHz. However, winding the transformer with the two three-wire cables requires that the two cables be wound onto the transformer core 300 in two separate steps or by using a technique to allow the two cables to be wound at the same time while maintaining the perimeters of the two cables against the inner surfaces 356 of the core.

Figure 8:
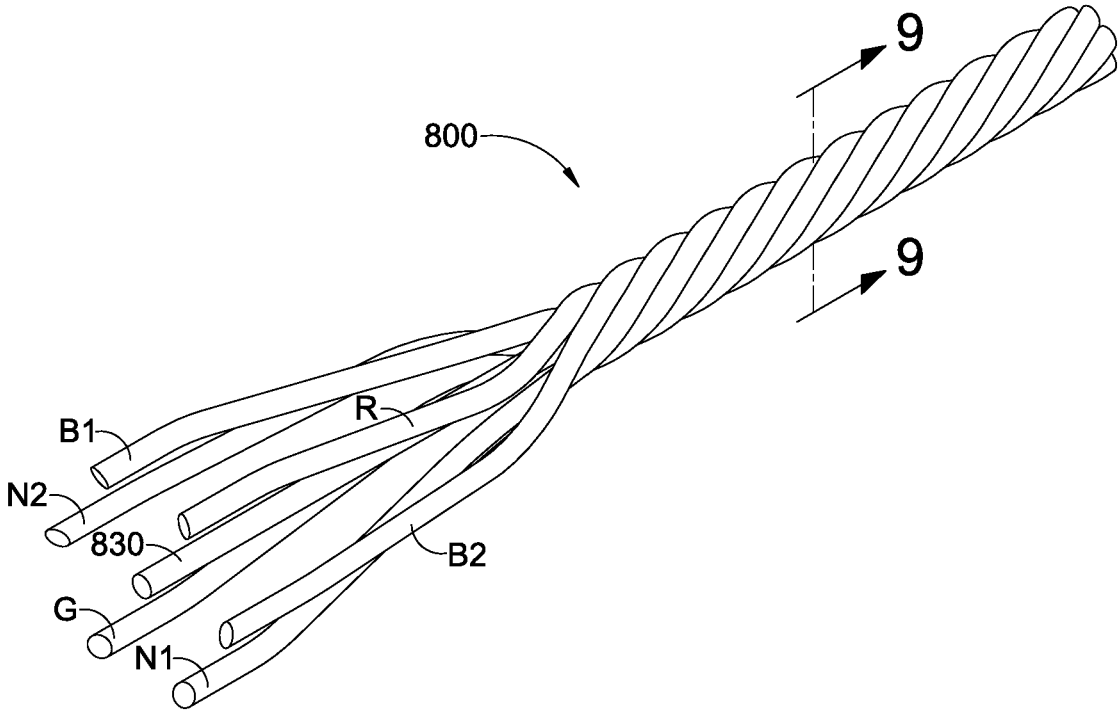
FIG. 8 illustrates a segment of a six-wire cable having a central non-conductive core around which the six conductive wires are wound in a twisted pattern.

If the bandwidth provided by the two interleaved three-wire cables 510, 512 is not required, the transformer core 300 can be wound with a single multi-wire cable. For example, FIG. 8 illustrates a segment of a multi-wire cable 800 that can be wound onto the transformer core in a single operation. As illustrated, the multi-wire cable includes six conductive magnet wires with a thin enameled insulator formed thereon. Such magnet wire is commercially available from many vendors. In the illustrated embodiment, the magnet wires comprise 38 gauge wires having outer diameters of approximately 0.0045 inch; however, the following description is readily adaptable to wires of a different gauge. For convenience in referring to the wires in the following discussion, the six wires are labeled as B1, B2, R, N1, N2 and G. The selected labels B, R, N and G may refer to blue, red, natural and green colors, respectively; however, other colors or other techniques may also be used to identify the wires. In a particular implementation, the six wires may have corresponding colors for the insulation to allow each particular wire to be easily identified when interconnected as described below.

As shown in FIG. 8, the six conductive magnet wires B1, B2, R, N1, N2, G in the cable 800 are twisted around a central non-conductive core filament 830 having a diameter generally corresponding to the diameter of each of the six magnet wires. For example, the core filament diameter may be the same as the diameter of the magnet wires, or the core filament diameter may be slightly larger than the diameter of the magnet wire. Preferably, the core filament comprises a non-magnetic material. For example, in one embodiment, the non-conductive, non-magnetic core filament comprises a monofilament material such as nylon, fluorocarbon, polyethylene, polyester, or other suitable material. Such materials may be similar to materials used for fishing line. The six conductive wires may be twisted in a clockwise or counter-clockwise direction around the central core filament. The clockwise twist direction is shown in FIG. 8. The twist density (or tightness) may be varied as required. In the illustrated embodiment, the twist density is selected to be in a range of 16 twists per inch (TPI) to 20 TPI. As illustrated, each of the six conductive wires is helically wound about the central non-conductive core filament with the start of the helical pattern of each conductive wire spaced apart angularly by 60 degrees with respect to the starts of the helical pattern of the two adjacent conductive wires. Accordingly, the centers of the six wires form a hexagonal pattern about the central non-conductive core filament as illustrated in the cross-sectional view of the six-wire cable in FIG. 9.

In the illustrated embodiment of the six-wire cable 800, the R wire is positioned between the B1 wire and the B2 wire, and the three wires form a first group of wires. The G wire is positioned between the N1 wire and the N2 wire, and the three wires form a second group of wires. The B1 wire is adjacent the N2 wire, and the B2 wire is adjacent to the N1 wire. The numbering of the B wires and the numbering of the N wires is arbitrary in the embodiment described herein because each B wire performs the same function and each N wire performs the same function as will be apparent in the following description. The six conductive wires are wound tightly around the central core 830. The inclusion of the central core prevents the six conductive wires from being forced inward during the twisting process. Thus, the six conductive wires retain the initial B1-R-B2-N1-G-N2 configuration around the central core throughout the twisting process. The three wires in each group remain together over the length of the cable with the R wire positioned tightly between the B1 and B2 wires and with the G wire positioned tightly between the N1 and N2 wires. The six conductive wires also retain the desired configuration when wound about the transformer core 300 as described below.

Figure 10:
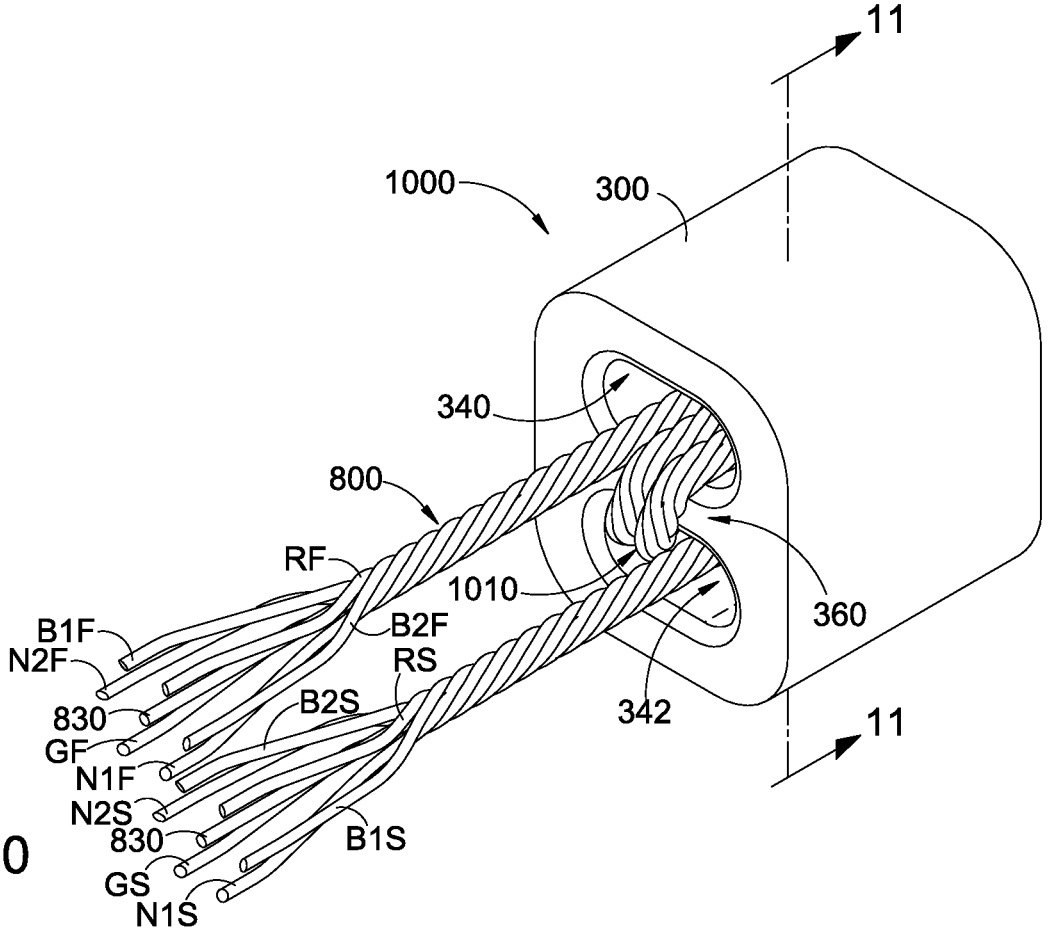
FIG. 10 illustrates a perspective view of a transformer incorporating the transformer core of FIGS. 3 and 4 and the six-wire cable of FIGS. 8 and 9.
Figure 11:
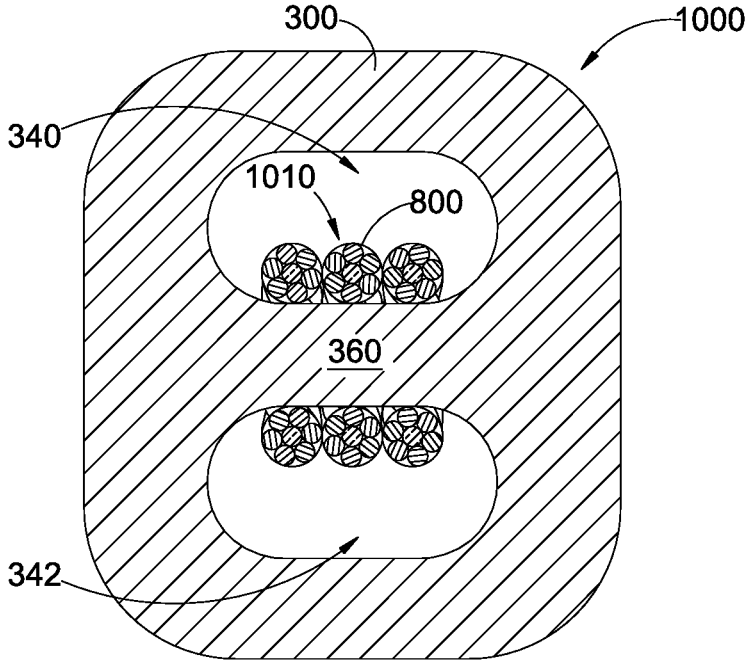
FIG. 11 illustrates a cross-sectional view of the transformer of FIG. 10 taken along the line 11-11 in FIG. 10.

The ease of winding the six-wire cable 800 is illustrated in FIGS. 10 and 11 wherein the six-wire cable is wound onto the transformer core 300 in the form of a three-turn coil 1010 threaded through the first (upper) elongated through-bore 340 and the second (lower) through-bore 342 to form a transformer 1000 structure around the central core portion 360 of the core. For the purposes of the following discussion, the three-turn coil "starts" as it enters the second (lower) elongated through bore and "finishes" as it exits the first (upper) elongated through-bore. Accordingly, a respective first end segment of each of the six wires N1, N2, B1, B2, G, R of the six-wire cable at the start end of the cable is labeled with a suffix "S" (e.g., N1S, N2S, B1S, B2S, GS, RS). A respective second end segment of each of the six wires at the finish end of the cable is labeled with a suffix "F" (e.g., N1F, N2F, B1F, B2F, GF, RF).

The previously described transformer 500 required three turns each of two three-wire cables 510, 512 to be wound onto the transformer core, for a total of six winding turns. Unlike the transformer 500 of FIG. 5, the transformer 1000 of FIG. 10 only requires the single three-turn single coil 1010 to be wound onto the transformer core. As shown in FIGS. 10 and 11, the three turns of the six-wire cable 800 in the single coil occupy substantially less longitudinal (e.g., left-to-right) space within the elongated through bores 340, 342 as compared to the six turns of the two three-wire cables described above. Thus, each of the three turns of the six-wire cable is positioned against the respective inner flat surfaces 356 of the through bores.

In addition to being easier to wind than the two three-wire cables 510, 512, the single six-wire cable 800 may improve the balance or symmetry between the first and second groups of windings. As discussed above, the first group of windings comprises the B1 wire and the B2 wire along with the R wire. The R wire is positioned tightly between the B1 wire and the B2 wire. The second group of windings comprises the N1 wire and the N2 wire along with the G wire. The G wire is positioned tightly between the N1 wire and the N2 wire. The wiring positions of the two groups of wires achieve symmetrical coupling between the two groups of wires (e.g., the coupling from the B1 and B2 wires to the R wire is similar to the coupling from the N1 and N2 wires to the G wire). A further advantage is that the six wires of the six-wire cable twist in unison as the cable is threaded through the elongated through bores and around the front surface 318 and rear surface 320 of the transformer core. Thus, the six wires experience similar electromagnetic perturbations and other perturbations.

The advantages of the single six-wire cable 800 over the two three-wire cables 510, 512 provided by the common helical winding about the central non-conductive core 810 are offset in part by a reduced bandwidth. The first set of wires N1, G, N2 are closely wound with respect to the second set of wires B1, R, B2. The close winding increases parasitic capacitive coupling between the two commonly wound sets of wires in comparison with the parasitic coupling between the two separately wound sets of wires in the two three-wire cables. The increased parasitic capacitive coupling may reduce the overall bandwidth of the transformer 1000 with respect to the transformer 500. For example, the transformer 1000 wound with the six-wire cable may operate at a bandwidth up to approximately 1,200 MHz in comparison to the approximately 1,800 MHz bandwidth of the transformer 500 wound with the two three-wire cables.

Figure 12:
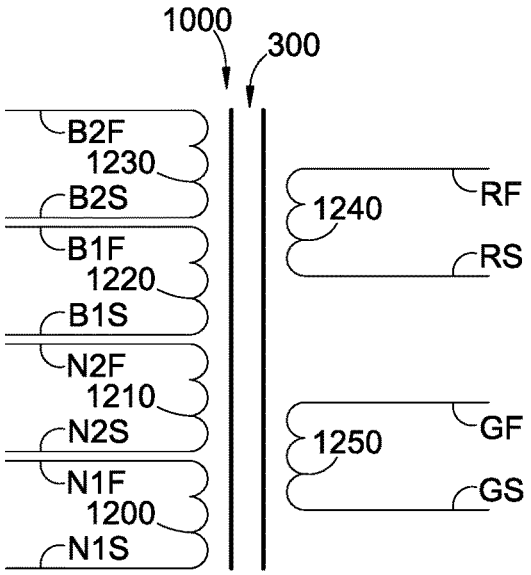
FIG. 12 illustrates a schematic diagram of the transformer of FIGS. 10 and 11 showing the six wires of the six-wire cable as windings about the core of the transformer.

FIG. 12 illustrates a basic schematic diagram of the transformer 1000 of FIGS. 10 and 11. As illustrated, the transformer comprises six windings wound onto the core 300. A first winding 1200 comprises the N1 wire between the start end segment N1S and the finish end segment N1F. A second winding 1210 comprises the N2 wire between the start end segment N2S and the finish end segment N2F. A third winding 1220 comprises the B1 wire between the start end segment B1S and the finish end segment B1F. A fourth winding 1230 comprises the B2 wire between the start end segment B2S and the finish end segment B2F. A fifth winding 1240 comprises the R wire between the start end segment RS and the finish end segment RF. A sixth winding 1250 comprises the G wire between the start end segment GS and the finish end segment GF.

Figure 13:
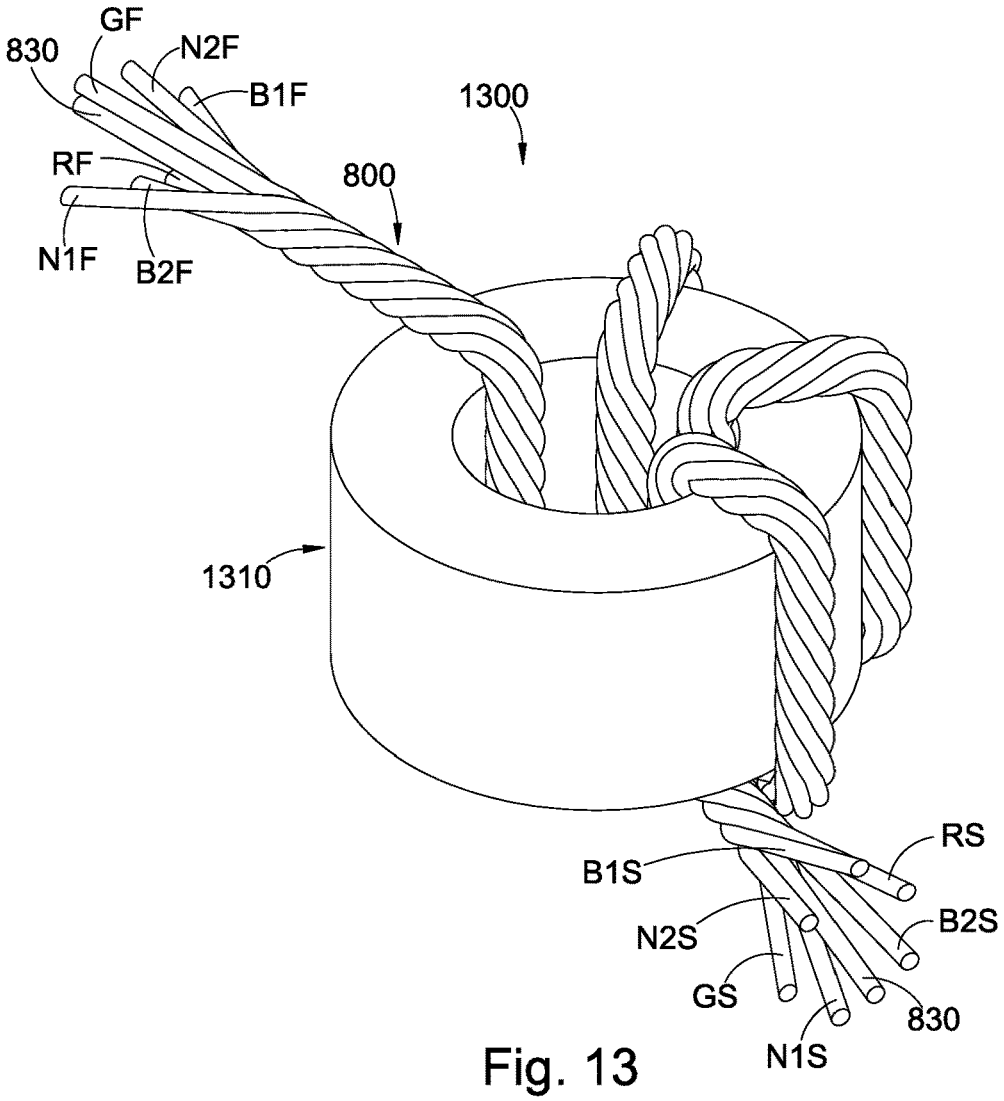
FIG. 13 illustrates a perspective view of a transformer in which the six-wire cable of FIG. 8 is wound onto a toroidal core structure.

The six-wire cable 800 of FIG. 8 can also be used with other transformer configurations. For example, FIG. 13 illustrates a perspective view of a transformer 1300 in which the six-wire cable of FIG. 8 is wound onto a toroidal core structure 1310. The toroidal transformer configuration of FIG. 13 includes the advantages of being able to wind all of the transformer windings in a single operation, as described above with respect to the transformer 1000 of FIGS. 10 and 11.

Figure 14:
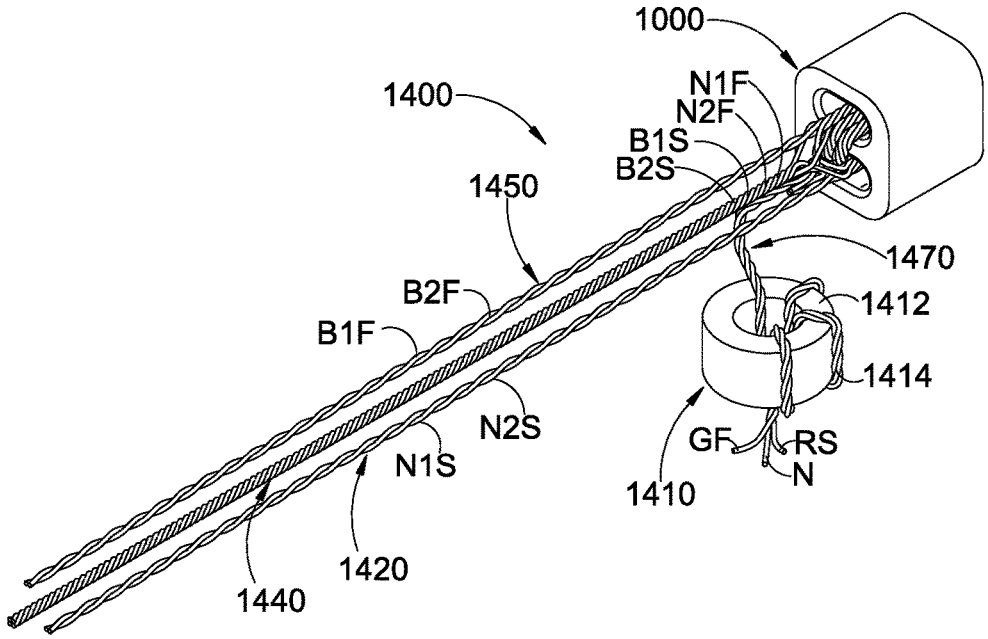
FIG. 14 illustrates a perspective view of a high data rate coupler system that incorporates the transformer of FIGS. 10 and 11 with the six-wire cable and a toroidal core wound with a three-wire cable.

FIG. 14 illustrates an embodiment of a high data rate coupler system 1400 that incorporates the transformer 1000 of FIGS. 10 and 11. For example, the high data rate coupler may operate at bandwidths up to 1,200 MHz.

Figure 9:
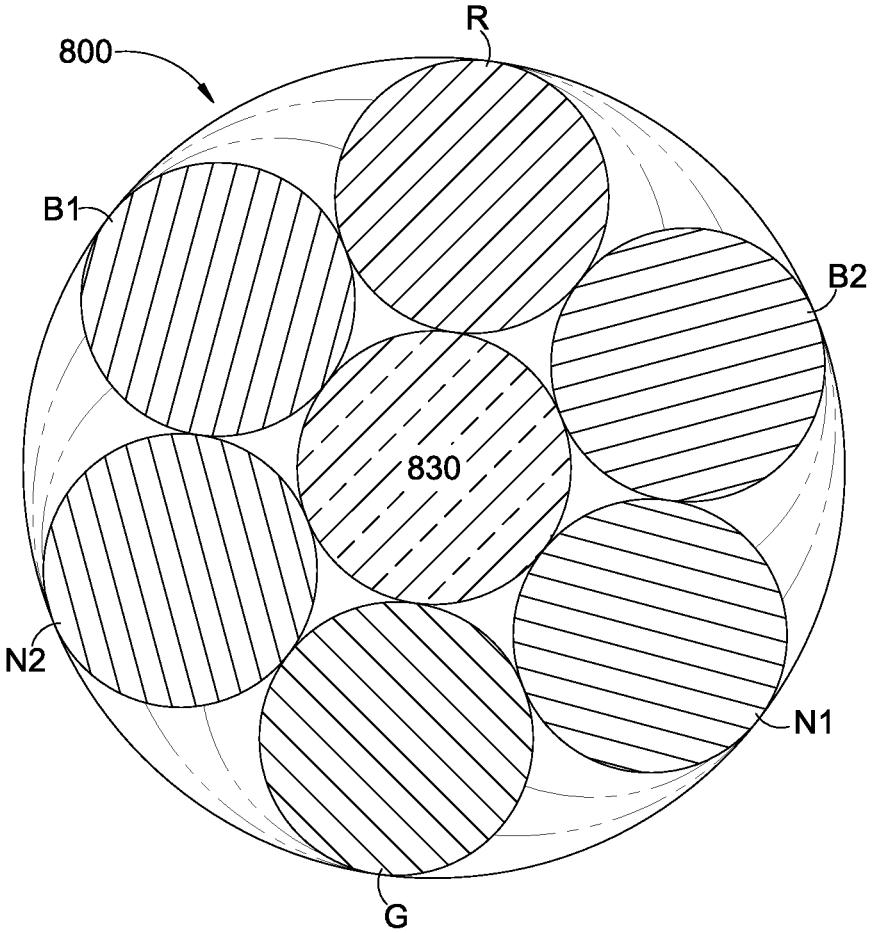
FIG. 9 illustrates a cross-sectional view of the six-wire cable of FIG. 8 taken along the line 9-9 in FIG. 8.
Figure 15:
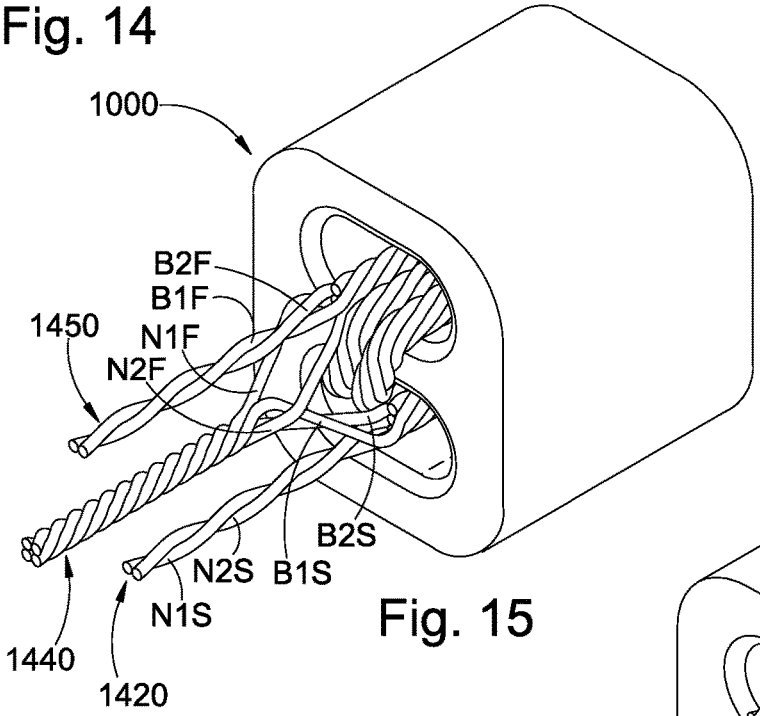
FIG. 15 illustrates an enlarged perspective view of the transformer of FIG. 14 showing the interconnections to the primary windings of the transformer in more detail.
Figure 16:
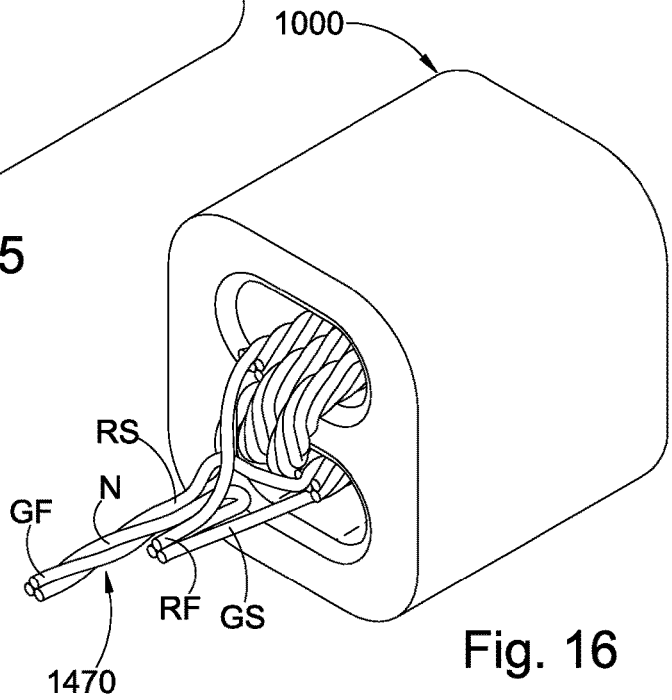
FIG. 16 illustrates an enlarged perspective view of the transformer of FIG. 14 showing the interconnections to the secondary windings of the transformer in more detail.

The coupler system 1400 of FIG. 14 includes the transformer 1000 wound with the six-wire cable 800 of FIGS. 8 and 9, as described above. The coupler system further includes a toroidal choke 1410 comprising a toroidal core 1412 wound with a coil 1414 having a plurality of turns (e.g., three turns) of a three-wire cable. The toroidal choke is connected to the transformer as described below. Extended ends of the six-wire cable are selectively interconnected to interconnect the transformer and the choke and to form leads to the transformer. An enlarged view of a first set of interconnections is shown in FIG. 15. An enlarged view of a second set of interconnections is shown in FIG. 16. When interconnected as shown in FIGS. 14-16, the transformer and the toroidal choke form the electrical circuit illustrated schematically in FIG. 17.

In FIG. 15, the R wire and the G wire of the three-turn coil 1010 are truncated at the first (upper) through-bore 340 and at the second (lower) through bore 342 of the core 300 so that only the connections to the N1 wire, the N2 wire, the B1 wire and the B2 wire are shown. As shown in FIG. 15 and as represented schematically in FIG. 17, the respective first end (start) segments N1S, N2S of the N1 wire and the N2 wire extending from the second (lower) elongated through-bore of the core 300 are twisted together to form a first two-wire cable 1420 with a twist density of between 16 and 20 twists per inch. The first two-wire cable formed by the first end segments N1S, N2S has a length extending from the three-turn coil of approximately 1 inch. The exposed distal ends (ends farthest from the three-turn coil) of the first end segments NHS, N2S are soldered or otherwise electrically connected together. As shown schematically in FIG. 17, the first two-wire cable forms a first outer lead 1432 of a primary winding 1430 of the center-tapped transformer 1000.

Figure 17:
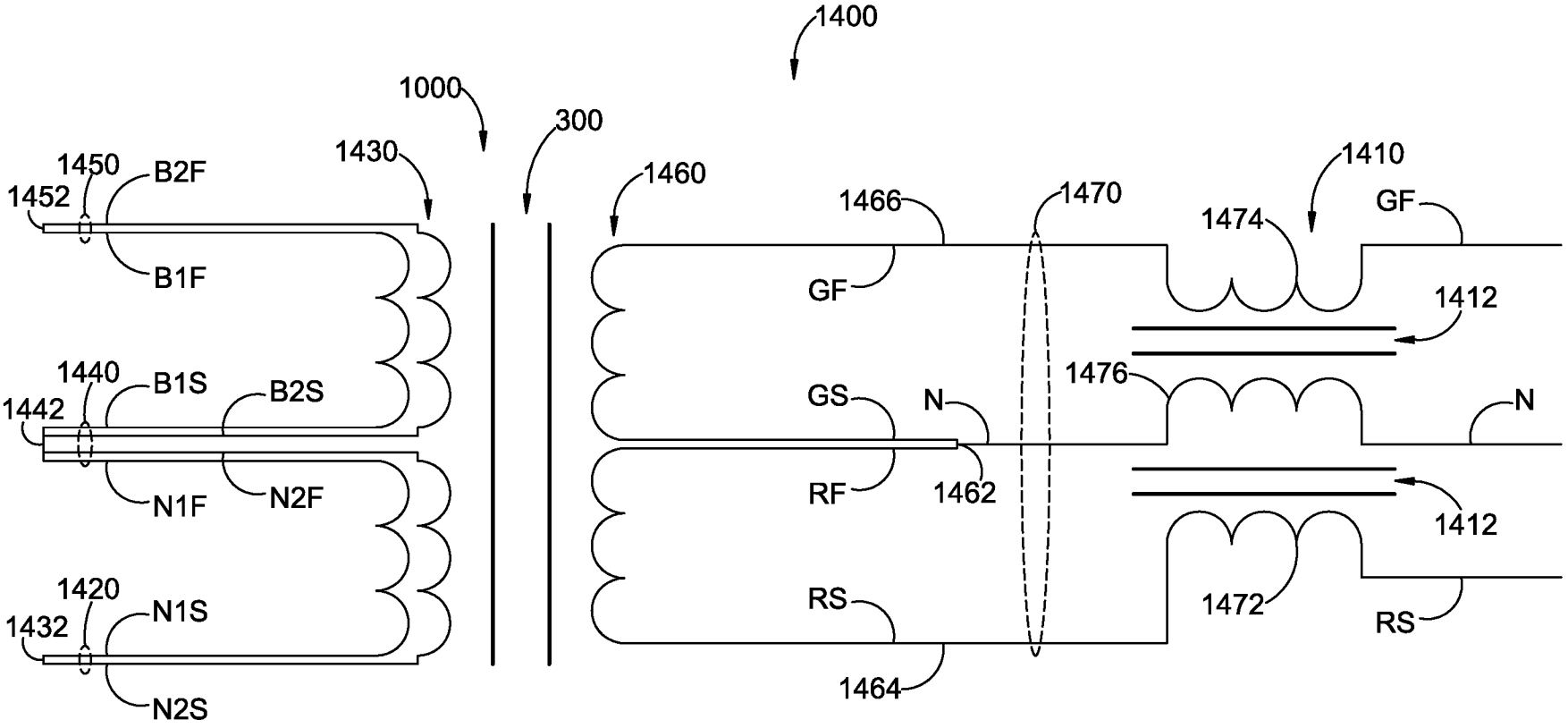
FIG. 17 illustrates a schematic diagram of the high data rate coupler system of FIGS. 14-16 showing the interconnections of the primary windings and the interconnections of the secondary windings and the toroidal coil.

As further shown in FIG. 15 and as shown schematically in FIG. 17, the respective second end segments N1F, N2F of the N1 wire and the N2 wire extending from the first (upper) elongated through-bore 340 of the core 300 are twisted together with the respective first end segments B1S, B2S of the B1 wire and the B2 wire extending from the second (lower) elongated through-bore 342. The four end segments N1F, N2F, B1S, B2S form a four-wire cable 1440 that that is twisted with a twist density of between 16 and 20 TPI. The four end segments may have a length of approximately 1 inch. The exposed distal ends of the four end segments are soldered or otherwise electrically connected together. As shown schematically in FIG. 17, the four end segments form a center-tap lead 1442 of the primary winding 1430 of the transformer 1000.

As further shown in FIG. 15 and as shown schematically in FIG. 17, the respective second end segments B1, B2F of the B1 wire and the B2 wire extending from the first (upper) elongated through-bore 340 of the core 300 are twisted together to form a second two-wire cable 1450 with a twist density of between 16 and 20 twists per inch. The second two-wire cable formed by the second end segments B1F, B2F has a length extending from the three-turn coil of approximately 1 inch. The exposed distal ends of the second end segments B1F, B2F are soldered or otherwise electrically connected together. The second two-wire cable forms a second outer lead 1452 of the primary winding 1440 of the center-tapped transformer 1000.

In FIG. 16, the extended portions of the R wire and the G wire of the three-turn coil 1010 are again shown. The extended portions of the N1 wire, the N2 wire, the B1 wire and the B2 wire are truncated at the first (upper) through-bore 340 and at the second (lower) through bore 342 of the core 300 so that the R wire and the G wire can be seen in FIG. 16. As shown in FIG. 16 and as represented schematically in FIG. 17, the first end segment RS of the R wire extends from the second (lower) elongated through-bore 340 by a distance of approximately 0.15 inch to approximately 0.2 inch. Similarly, the second end segment GF of the G wire extends from the first (upper) elongated through-bore 342 by a distance of approximately 0.1 inch to approximately 0.15 inch. The distal ends of the end segment RS and the end segment GF are electrically connected to a first end of a third N wire. The third N wire (without a suffix) is not part of the six-wire cable 800 of the transformer 1000. As shown in FIG. 16, the two end segments RF, GS and the end of the N wire form a center-tap 1462 of a secondary winding 1460 of the transformer.

As further shown in FIG. 17, the first end segment RS of the R wire forms a first outer lead 1464 of the center-tapped secondary winding 1460 of the transformer 1000. The second end segment GF of the G wire forms a second outer lead 1466 of the secondary winding. The first end segment RS of the R wire and the second end segment GF of the G wire are twisted together with the third N wire to form a three-wire cable 1470 that extends from the transformer 1000 to the toroidal choke 1410, which is spaced apart from the transformer by approximately 0.1 inch to 0.15 inch. In the illustrated embodiment, the three-wire cable is twisted together with a twist density of approximately 10 twists per inch. As illustrated in FIG. 14, the three-wire cable is wound around the toroidal core 1412 of the toroidal choke to form the three-turn toroidal coil 1414. The three turns of the coil are distributed evenly over approximately 180 degrees of the circular core. As shown schematically in FIG. 17, the RS end segment of the R wire is wound into a first coil 1472 to form a first winding of the toroidal choke and the GF end segment of the G wire is wound into a second coil 1474 to form a second winding of the toroidal choke. The toroidal choke operates in a conventional manner to suppress common mode noise in the RS end segment of the R wire and the GF end segment of the G wire when the two wires form part of a data communications line. The N wire connected to the center-tap 1462 of the secondary winding 1460 of the transformer 1000 also passes through toroidal core as a third coil 1476 wound with the first and second coils. The N wire is electrically connectable to a source (or a destination) for a DC voltage that provides power over an Ethernet cable, as described, for example, in US Patent Application Publication No. 2016/0187951 A1 to Buckmeier et al., which published on Jun. 30, 2016, and which is incorporated by reference herein in its entirety.

In alternative embodiments, the N wire may be extracted from the three-wire cable 1470 prior to bypass the winding of the toroidal choke 1410 such that the toroidal core is wound with only two wires, the RS end segment of the R wire and the GF end segment of the G wire. In a further alternative configuration, if power over an Ethernet cable is not required, the N wire from the center tap of the secondary winding of the transformer can be eliminated such that the toroidal core is wound with only two wires, the RS end segment of the R wire and the GF end segment of the G wire and is only connected to the isolation transformer by the two end segments.

As illustrated in FIGS. 14, 15 and 16, the extended end segments of the six wires are continuous segments of the six-wire cable 800 forming the three-turn coil 1010. The two outer leads 1432 and 1452 and the center-tap lead 1442 of the primary winding 1430 of the transformer 1000 only require electrical connections to other circuitry (not shown) into which the coupler system 1400 is incorporated. Similarly, the R wire and the G wire of the toroidal choke 1410 are uninterrupted continuations of the RS end segment of the R wire and the GF segment of G wire, respectively. The only electrical connection made within the immediate vicinity of the transformer is the electrical connection from the third N wire and the RF end segment of the R wire and the GS segment of the G wire. By eliminating the electrical interconnections between the wires within the transformer and the toroidal choke, the transformer is compact and simple to manufacture. Accordingly, the combination of the transformer core 300, which has the elongated through-bores 340, 342, and the six-wire cable 800, which has all of the winding wires combined into a single compact cable provide substantial improvements in manufacturability and functionality.

Figure 18:
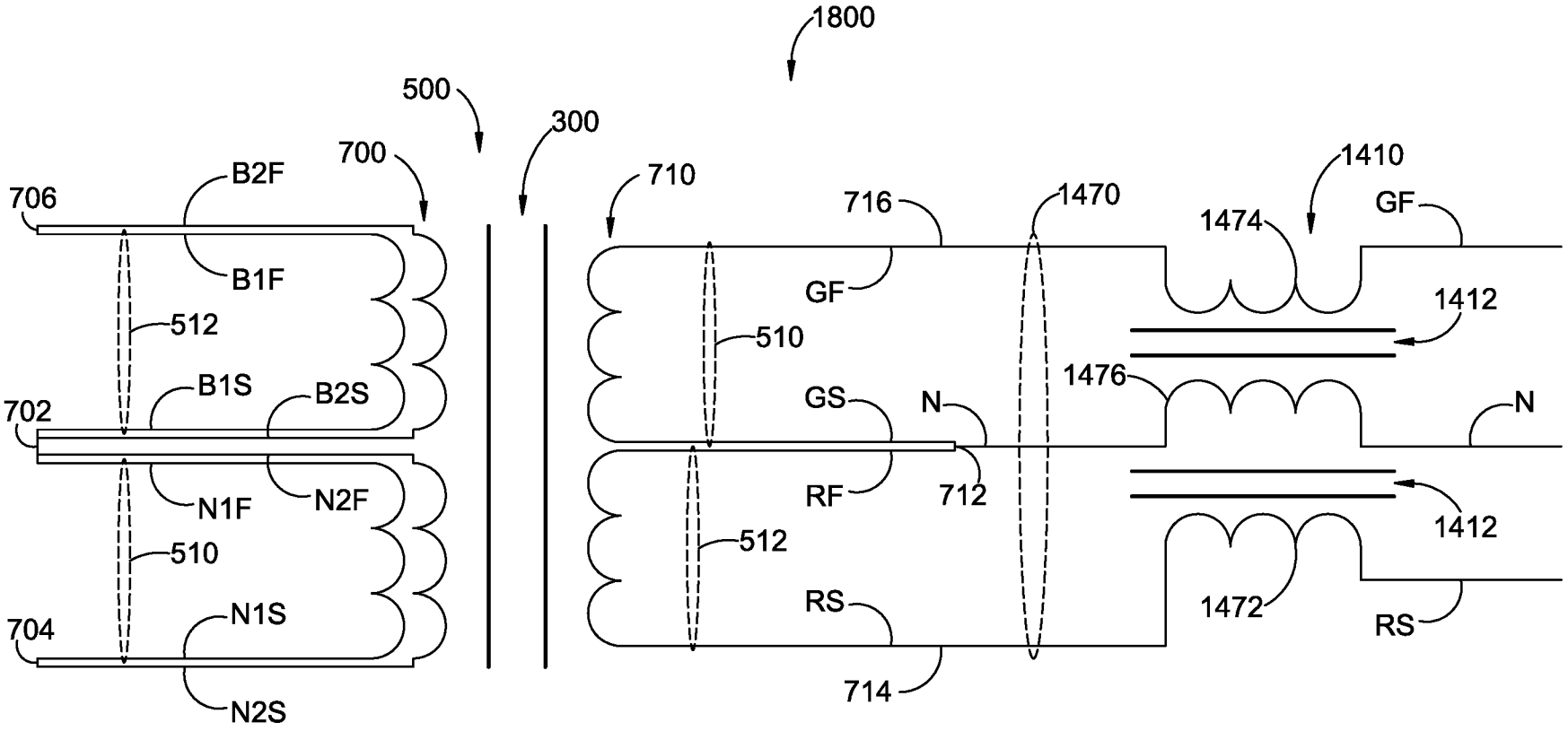
FIG. 18 illustrates a schematic diagram of a high data rate coupler system similar to the system of FIG. 17 which incorporates the transformer of FIGS. 5 and 6 in place of the transformer of FIGS. 10 and 11.
Figure 19:
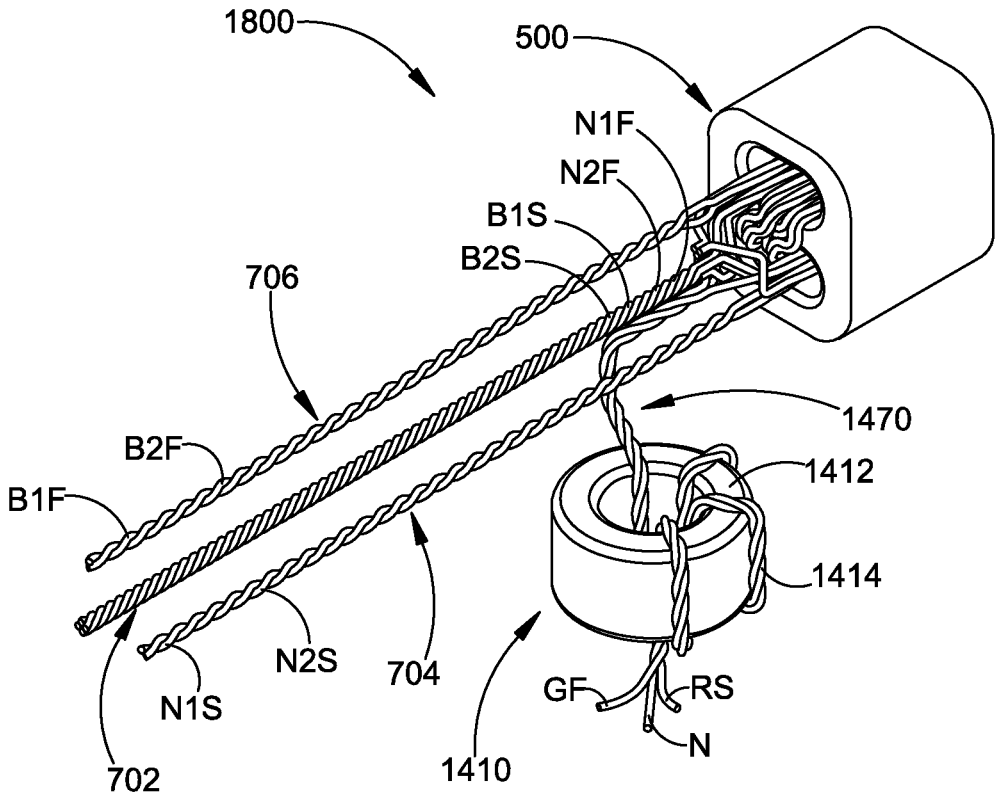
FIG. 19 illustrates a perspective view of a high data rate coupler system that incorporates the transformer of FIGS. 5 and 6 with the two three-wire cables and a toroidal core wound with a three-wire cable.

FIGS. 18 and 19 illustrate a coupler system 1800, which is similar to the coupler system 1400 of FIGS. 14-17, and which operates at a higher data rate. The coupler system of FIGS. 18 and 19 is implemented with the transformer 500 of FIGS. 5 and 6, which incorporates the two three-wire cables 510, 512. As described above, the N1S and N2S end segments of the two cables are connected together to form the first outer lead 704 of the primary winding 700. The N1F, N2F, B1S and B2S end segments are connected together to form the center-tap 702 of the primary winding. The B1F and B2F end segments are connected together to form the second outer lead 706 of the primary winding. The RS end segment forms the first outer lead 714 of the secondary winding 710 of the transformer. The RF and GS end segments and an additional N wire form the center-tap 712 of the secondary winding. The GF end segment forms the second outer lead 716 of the secondary winding. The toroidal coil 1410 is implemented as described above by twisting the first outer lead, the second outer lead and the additional N wire together and winding the three wires onto the toroidal core 1412 to form the three coils of the toroidal choke. The coupler system of FIGS. 18 and 19 may operate at bandwidths of 1,800 MHz in accordance with the requirements of the IEEE 802.3bq-2016 for a 40GBaseT interface.

Figure 20:
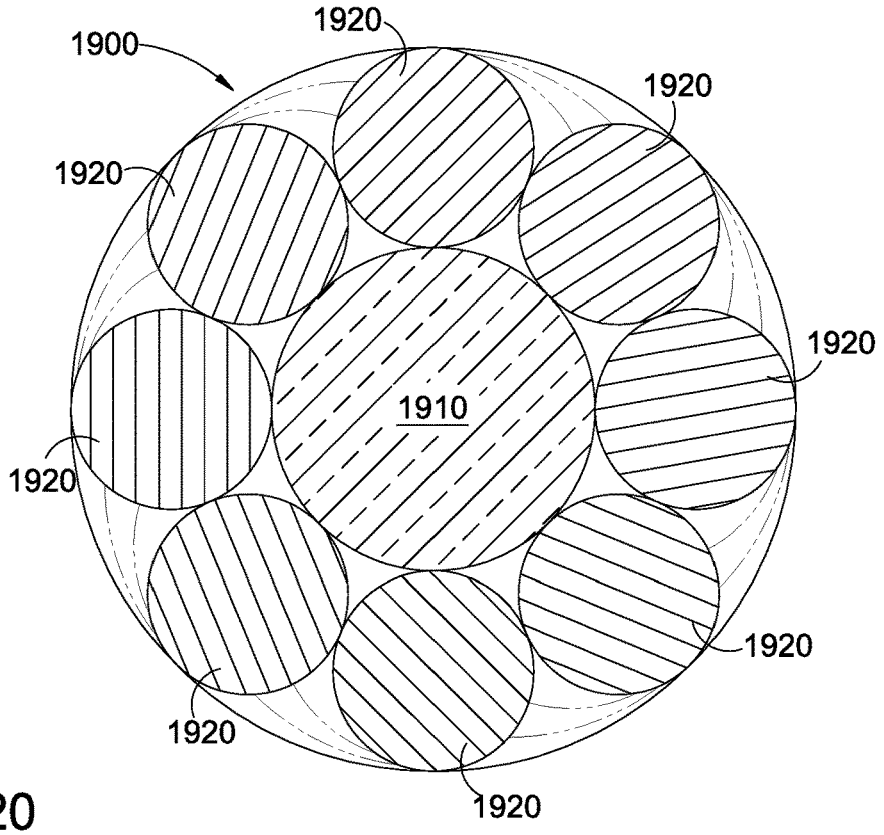
FIG. 20 illustrates a cross-sectional view similar to the view of FIG. 9 wherein the multi-wire cable comprises eight conductive wires around a non-conductive core.
Figure 21:
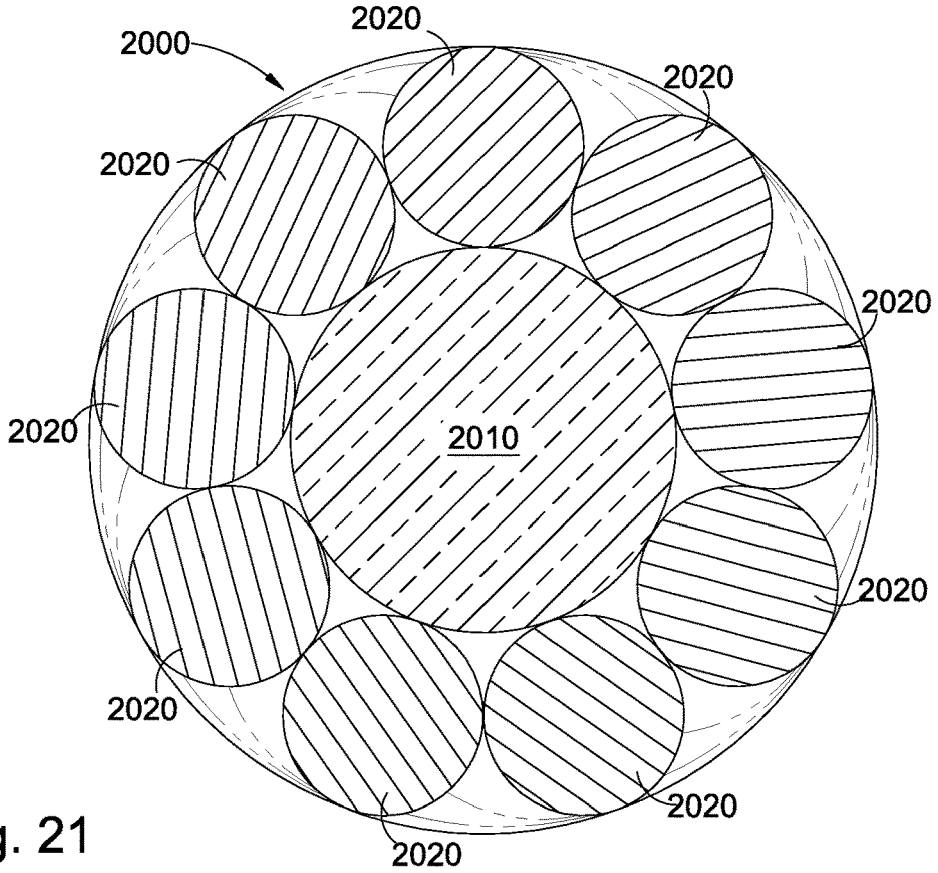
FIG. 21 illustrates a cross-sectional view similar to the view of FIG. 9 wherein the multi-wire cable comprises nine conductive wires around a non-conductive core.

The multi-wire cable of FIGS. 8 and 9 can be configured to have additional conductive wires around the non-conductive core. For example, FIG. 20 illustrates a cross-sectional view of a cable 1900 comprising eight conductive wires 1920 helically around a non-conductive core 1910. In the illustrated embodiment wherein the conductive wires are 38 gauge wires (e.g., approximately 0.0045 inch in diameter), the non-conductive core has a diameter of approximately 0.0073 inch, which is slightly larger than the diameter of a 34 gauge magnet wire. In FIG. 20, each helically wound wire is spaced apart angularly by 45 degrees from the two adjacent wires. As a further example, FIG. 21 illustrates a cross-sectional view similar to the view of FIG. 9 wherein the multi-wire cable comprises nine conductive wires 2020 around a non-conductive core 2010. In the illustrated embodiment wherein the conductive wires are 38 gauge wires (e.g., approximately 0.0045 inch in diameter), the non-conductive core in FIG. 21 has a diameter of approximately 0.0087 inch, which is slightly larger than the diameter of a 32 gauge magnet wire. In FIG. 21, each helically wound wire is spaced apart angularly by 40 degrees from the two adjacent wires.

One skilled in art will appreciate that the foregoing embodiments are illustrative of the present invention. The present invention can be advantageously incorporated into alternative embodiments while remaining within the spirit and scope of the present invention, as defined by the appended claims.

What is claimed is:

1. An isolation transformer comprising:

a transformer core having a first surface and a second surface;

a first through-bore extending through the transformer core from the first surface to the second surface, the first through-bore having an elongated profile with at least a portion of the elongated profile providing a first flat winding surface;

a second through-bore extending through the transformer core from the first surface to the second surface, the second through-bore having an elongated profile with at least a portion of the elongated profile providing a second flat winding surface, the second flat winding surface spaced apart from the first flat winding surface by a central portion of the transformer core;

a first three-wire cable comprising a first conductive wire, a second conductive wire, and a third conductive wire, the second conductive wire positioned between the first conductive wire and the third conductive wire, the first, second and third conductive wires twisted together, the first three-wire cable threaded through the first through-bore and around the central portion of the transformer core; and a second three-wire cable comprising a fourth conductive wire, a fifth conductive wire, and a sixth conductive wire, the fifth conductive wire positioned between the fourth conductive wire and the sixth conductive wire, the fourth, fifth and sixth conductive wires twisted together, the second three-wire cable threaded through the first through-bore and the second through-bore and around the central portion of the transformer core, the second three-wire cable interleaved with the first three-wire cable such that one turn of the first three-wire cable is positioned between adjacent turns of the second three-wire cable, wherein the first and third conductive wires of the first three-wire cable are connected in parallel to form a first primary winding of the isolation transformer, and the fourth and sixth conductive wires of the second three-wire cable are connected in parallel to form a second primary winding of the isolation transformer, the first and second primary windings connected in series to form a center-tapped primary winding; and the second conductive wire of the first three-wire cable forms a first secondary winding of the isolation transformer, and the fifth conductive wire of the second three-wire cable forms a second secondary winding of the isolation transformer, the first and second secondary windings connected in series to form a center-tapped secondary winding.

2. The isolation transformer as defined in claim 1, wherein each of the first and second through-bores has an oval-shaped profile having a central rectangular portion, a first semicircular end portion and a second semicircular end portion, each of the first and second flat winding portions defined by a respective side of the central rectangular portion of the respective through-bore.

* * * * *